US012715486B2

(12) United States Patent
Simson

(10) Patent No.: US 12,715,486 B2
(45) Date of Patent: Aug. 25, 2026

(54) COUPLING ARRANGEMENT

(71) Applicant: Bradken Resources Pty Limited, New South Wales (AU)

(72) Inventor: Scott Andrew Simson, New South Wales (AU)

(73) Assignee: Bradken Resources Pty Limited, New South Wales (AU)

( * ) Notice: Subject to any disclaimer, the term of this patent is extended or adjusted under 35 U.S.C. 154(b) by 572 days.

(21) Appl. No.: 18/034,490

(22) PCT Filed: Oct. 22, 2021

(86) PCT No.: PCT/AU2021/051234
§ 371 (c)(1),
(2) Date: Apr. 28, 2023

(87) PCT Pub. No.: WO2022/087654
PCT Pub. Date: May 5, 2022

(65) Prior Publication Data

US 2024/0343276 A1 Oct. 17, 2024

(30) Foreign Application Priority Data

Oct. 30, 2020 (AU) ..... 2020903942
Aug. 19, 2021 (AU) ..... 2021218170

(51) Int. Cl.
*B61G 3/06* (2006.01)

(52) U.S. Cl.
CPC ..... *B61G 3/06* (2013.01)

(58) Field of Classification Search
CPC ..... B61G 3/00; B61G 3/06; B61G 3/08
See application file for complete search history.

(56) References Cited

U.S. PATENT DOCUMENTS 431,415 A 7/1890 Thurmond
464,825 A 12/1891 Hinson
(Continued)

FOREIGN PATENT DOCUMENTS

CN 108839665 A 11/2018

OTHER PUBLICATIONS

International Preliminary Report on Patentability dated Feb. 22, 2023, directed to International Application No. PCT/AU2021/051234; 24 pages.

(Continued)

*Primary Examiner* — Robert J McCarry, Jr.
(74) *Attorney, Agent, or Firm* — Morrison & Foerster LLP

(57) ABSTRACT

Disclosed is a coupler for a coupling arrangement for a rail wagon. The coupler comprising a body and a knuckle. The body has a head portion at one end for engaging with a knuckle and a butt portion at an opposing end for engaging with a yoke. The knuckle extends between a protruding portion that engages a complementary knuckle of a coupler for an adjoining rail wagon, and a tail extending along a longitudinal axis for coupling the knuckle with the head portion of the coupler. The head portion comprises an interior wall defining an interior cavity for engaging the tail of the knuckle. The coupler is configured such that in use loading induced in the coupler is transferred between the knuckle and the head portion along a substantially evenly distributed load path.

12 Claims, 11 Drawing Sheets

(56) References Cited

U.S. PATENT DOCUMENTS

| | | | | |
|---|---|---|---|---|
| 472,799 | A | 4/1892 | McKeen | |
| 516,881 | A | 3/1894 | Swan | |
| 686,518 | A | 11/1901 | Hazlett et al. | |
| 813,930 | A | 2/1906 | Warner et al. | |
| 3,097,751 | A | 7/1963 | Henricot | |
| 2013/0206716 | A1 | 8/2013 | Burgoyne et al. | |
| 2015/0017323 | A1 | 1/2015 | Ruebusch et al. | |
| 2015/0375762 | A1 | 12/2015 | Mautino et al. | |
| 2016/0288806 | A1* | 10/2016 | Manibharathi ..... | B61G 3/06 |

OTHER PUBLICATIONS

International Search Report and Written Opinion dated Nov. 17, 2021, directed to International Application No. PCT/AU2021/051234; 11 pages.

* cited by examiner

COUPLING ARRANGEMENT

CROSS-REFERENCE TO RELATED APPLICATIONS

This application is a national stage application under 35 USC 371 of International Application No. PCT/AU2021/051234, filed Oct. 22, 2021, which claims the priority of Australian Application No. 2020903942, filed Oct. 30, 2020, and Australian Application No. 2021218170, filed Aug. 19, 2021, the entire contents of each priority application of which are incorporated herein by reference.

FIELD OF THE DISCLOSURE

This disclosure relates to a coupler for a coupling arrangement for a heavy haul rail wagon and a coupling arrangement for a heavy haul rail wagon.

BACKGROUND OF THE DISCLOSURE

Rail couplers are used to connect rail wagons for both freight and passenger cars. Known and commonly used couplers are Alliance couplers, which may also be known as Janney, buckeye, or knuckle couplers. The known couplers include a knuckle which allows the couplers to open and close. When uncoupled at least one knuckle of adjoining couplers is open. Upon impact with the other coupler, one or both of the knuckles swing into the closed position and secures the two couplers together.

The coupling arrangement including the knuckles are part of the primary load path for all in-train buff and draw loads. The knuckles include movable components which means that the load path is convoluted, and unevenly distributed through the knuckle and coupler. This leads to several areas of stress concentrations which fatigue and limit the life of these components.

Failure of the knuckles and couplers result in train separation. Separation results in large losses of revenue due to a combination of downtime for the separated train, delays to following trains, and disruption to docking facilities.

Due to increasing demands of heavy haul trains some couplers can experience very high axial loads. For example, some heavy haul trains can experience in-train forces in excess of 3 MN. Such loads and forces may exceed the safe operational limits of the coupler and/or knuckle. This may in some instances lead to reduced service life or operational failure of the coupler and its components.

For example, in Australia AS 7524.2 dictates that Type D Alliance coupler bodies and knuckles should meet the permanent set and ultimate strength requirements prescribed in AAR Specification M-211. Under these requirements, the knuckle is designed to a standard of 2.9 MN—a minimum ultimate load that is lower than the potential in-train forces experienced during heavy haul usage.

It may thus be desirable that the strength of both the coupler and corresponding knuckle be suitable for such heavy haul use.

It is to be understood that, if any prior art is referred to herein, such reference does not constitute an admission that the prior art forms a part of the common general knowledge in the art, in Australia or any other country.

SUMMARY OF THE DISCLOSURE

Disclosed is a coupler for a coupling arrangement for a rail wagon, the coupler comprising a body and a knuckle, the body having a head portion at one end for engaging with a knuckle and a butt portion at an opposing end for engaging with a yoke; the knuckle extending between a protruding portion that engages a complementary knuckle of a coupler for an adjoining rail wagon, and a tail extending along a longitudinal axis for coupling the knuckle with the head portion of the coupler; the head portion comprising an interior wall defining an interior cavity for engaging the tail of the knuckle, wherein the coupler is configured such that in use loading induced in the coupler is transferred between the knuckle and the head portion along a substantially evenly distributed load path.

In some embodiments, in use the loading induced in the coupler is transferred between the knuckle and the head portion along a substantially direct load path.

In some embodiments, the load path is non-convoluted so as to be substantially devoid of areas of significant stress concentration.

In some embodiments, the interior wall defines a generally T-shaped interior cavity, the T-shaped cavity including a cross-bar cavity and a stem cavity, an end of the stem cavity meeting a middle region of the cross-bar cavity. The cross-bar cavity may include a first end cavity located at one end of the cross-bar cavity, a middle cavity and a second end cavity located at a second end of the cross-bar cavity. The middle cavity includes the middle region where the cross-bar cavity meets the stem. The interior wall may include a lock-facing wall defining a portion of the first end cavity, and the interior wall may include a lug-facing wall defining a portion of the stem cavity, and a corner is formed between the lock-facing wall and the lug-facing wall. The lug-facing wall may extend generally perpendicular to the lock-facing wall. The lug-facing wall may extend linearly from the corner to an end of the stem cavity. The lug-facing wall may extend continuously from the corner to an end of the stem cavity.

In some embodiments, the knuckle is rotatable between an open and closed position. In the open position the coupler and the complementary knuckle are capable of being disengaged. The knuckle may be movable to the open position by manual force. Movement of the rail wagon away from the adjoining rail wagon may move the knuckle to the open position.

In some embodiments, the coupler does not include a kicker to throw the knuckle to the open position. In some embodiments, the coupler includes a kicker which is positioned exterior the interior cavity. In some embodiments, the coupler includes a kicker which is positioned within the interior cavity. In some embodiments, the coupler includes a kicker which is repositionable within the interior cavity.

In some embodiments, the knuckle includes upper and lower lugs configured to engage corresponding upper and lower lugs defined by the interior wall of the interior cavity of the head portion. The lugs may be arranged to transfer the substantially evenly distributed load. Each lug may include an engagement surface or shoulder extending in a lateral direction relative to the longitudinal axis. The engagement surfaces are configured to engage the head portion.

In some embodiments, the coupler further comprises a lock moveable from a locked to an unlocked position positioned within the interior cavity of the head portion, and when the lock is in the locked position, the knuckle is retained in the closed position.

Prior art couplers include a kicker and a kicker cavity to accommodate the kicker in the head portion of the coupler body. The kicker cavity prevents an evenly distributed load path between the engagement surfaces of the coupler body and the knuckle. The kicker cavity increases the convolution of the load path. This causes high stress and reduces fatigue life. Frequently, prior art coupler fatigue occurs in the knuckle. Over the life of the prior art coupler, the knuckle will be replaced a few times, and the coupler requires frequent inspections to verify its viability.

Advantageously, the coupler disclosed herein includes a substantially evenly distributed load path between the knuckle and the coupler, and thus may have a prolonged fatigue life and may improve the operational reliability of the coupler. The coupler disclosed herein may also include the benefits of reducing inspection frequency and eliminating the costs of replacing knuckles or the entire coupler as frequently as the prior art coupler.

BRIEF DESCRIPTION OF THE FIGURES

Embodiments will now be described by way of example only, with reference to the accompanying drawings in which.

DETAILED DESCRIPTION

Figure 1:
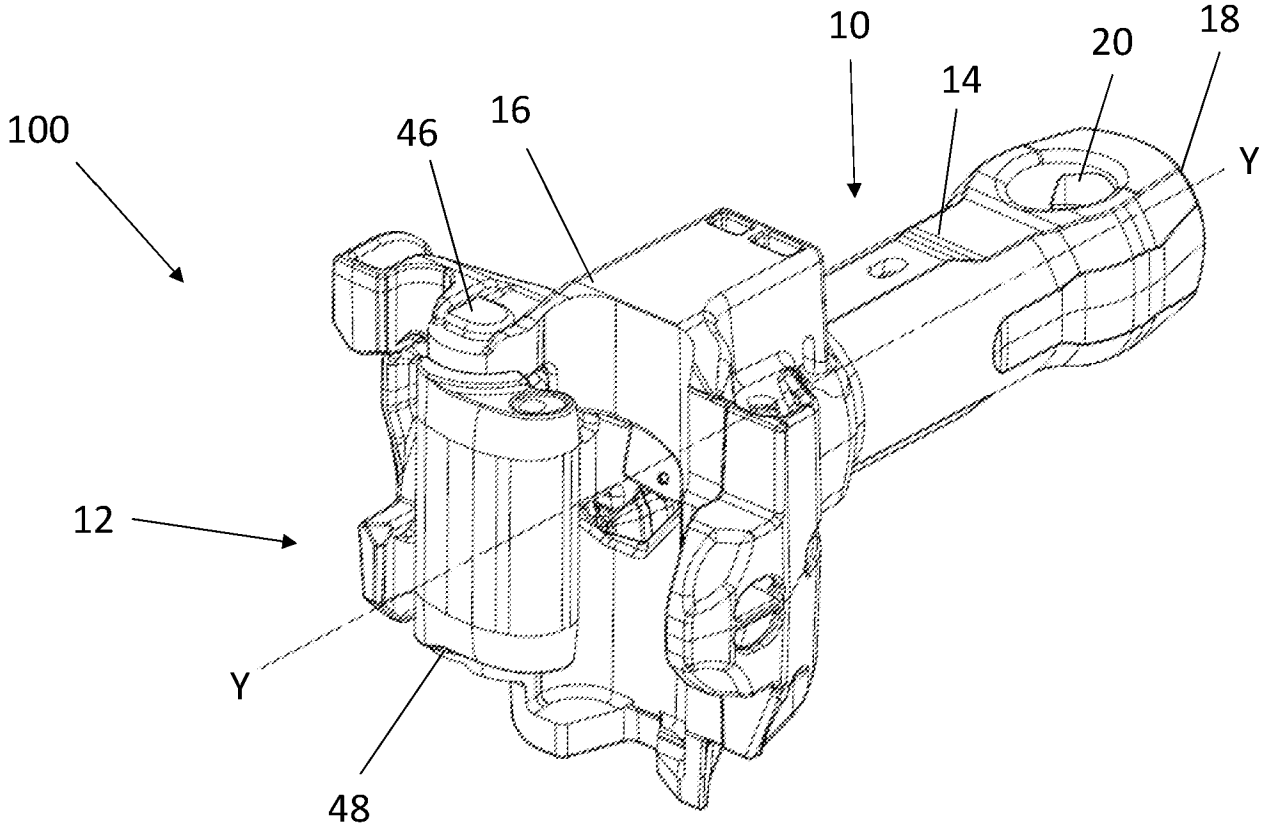
FIG. 1 is a perspective view of an embodiment of a coupler.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Rail wagons are coupled together via a coupling arrangement. The coupling arrangement facilitates the connection and disconnection of the rail wagons, is subject to the trains forces, and in some forms, facilitates the discharge of loads contained in the wagons. The disclosed coupler may be used for both intermodal and heavy haul fleets. Embodiments of the coupler disclosed herein may be in the form of rotary couplers or fixed couplers. In the illustrated embodiment, disclosed is a bottom-operated coupler which may be used as a rotary coupler. In non-illustrated alternative embodiments, also disclosed is a top operated coupler which may be used as a rotary or a fixed coupler. The top operated coupler includes an aperture above the lock to accept the lifter.

With reference to the Figures, a coupler 100 is disclosed including a coupler body 10 and a knuckle 12. The body 10 comprises an elongate shank 14 that extends along a shank axis Y-Y of the body 10 between a head portion 16 at a first end of the shank 14 and a butt portion 18 at an opposing second end of the shank 14. The butt portion 18 of shank 14 has a yoke pin connecting aperture 20 extending vertically (when in use) through the butt end of the shank 14.

The knuckle 12 couples with the head portion 16 of the coupler 100. The coupler 100 is configured such that in use loading induced in the coupler 100 is transferred between the knuckle 12 and the head portion 16 along substantially evenly distributed load path, and in some forms, a substantially direct load path.

The head portion 16 comprises an interior wall 22 defining an interior cavity 24 that is arranged to at least in part house the components of an actuator mechanism including a lock 26. The interior cavity 24 is also configured to receive a tail 28 of the knuckle 12. The actuator mechanism allows movement of the knuckle 12 between an open and closed position which facilitates respectively uncoupling and coupling of the coupler 100 from a complementary knuckle of a coupler for an adjoining rail wagon (not shown). The interior cavity 24 is shaped to house the actuator mechanism, the lock 26 and transfer load between the knuckle 12 and the coupler body 10 including the head portion 16.

Figure 2:
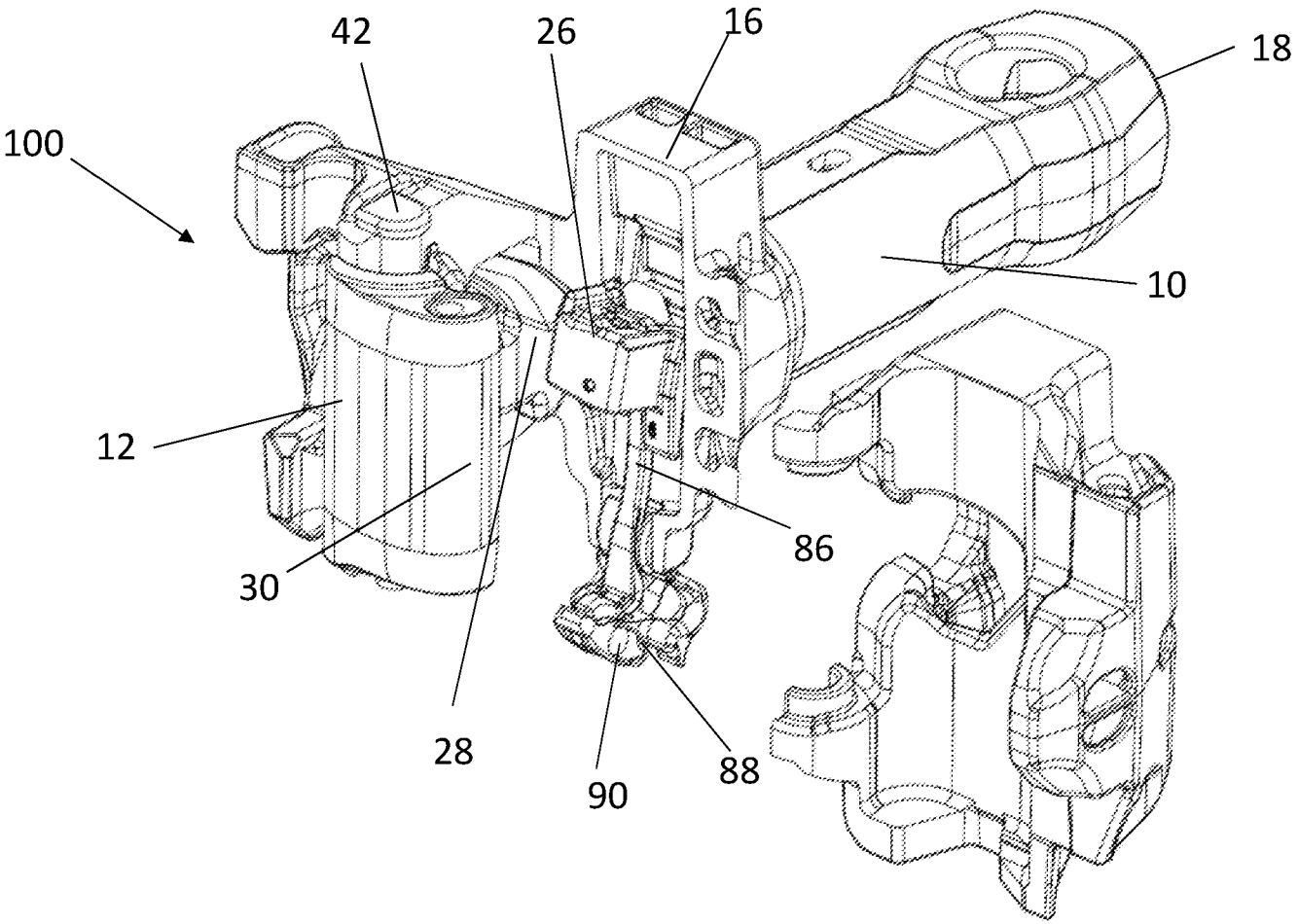
FIG. 2 is a perspective view of the coupler of FIG. 1 including embodiment of a coupler body having a portion of the coupler body cut away to show an embodiment of a lock and a knuckle in position relative to the coupler body.
Figure 3:
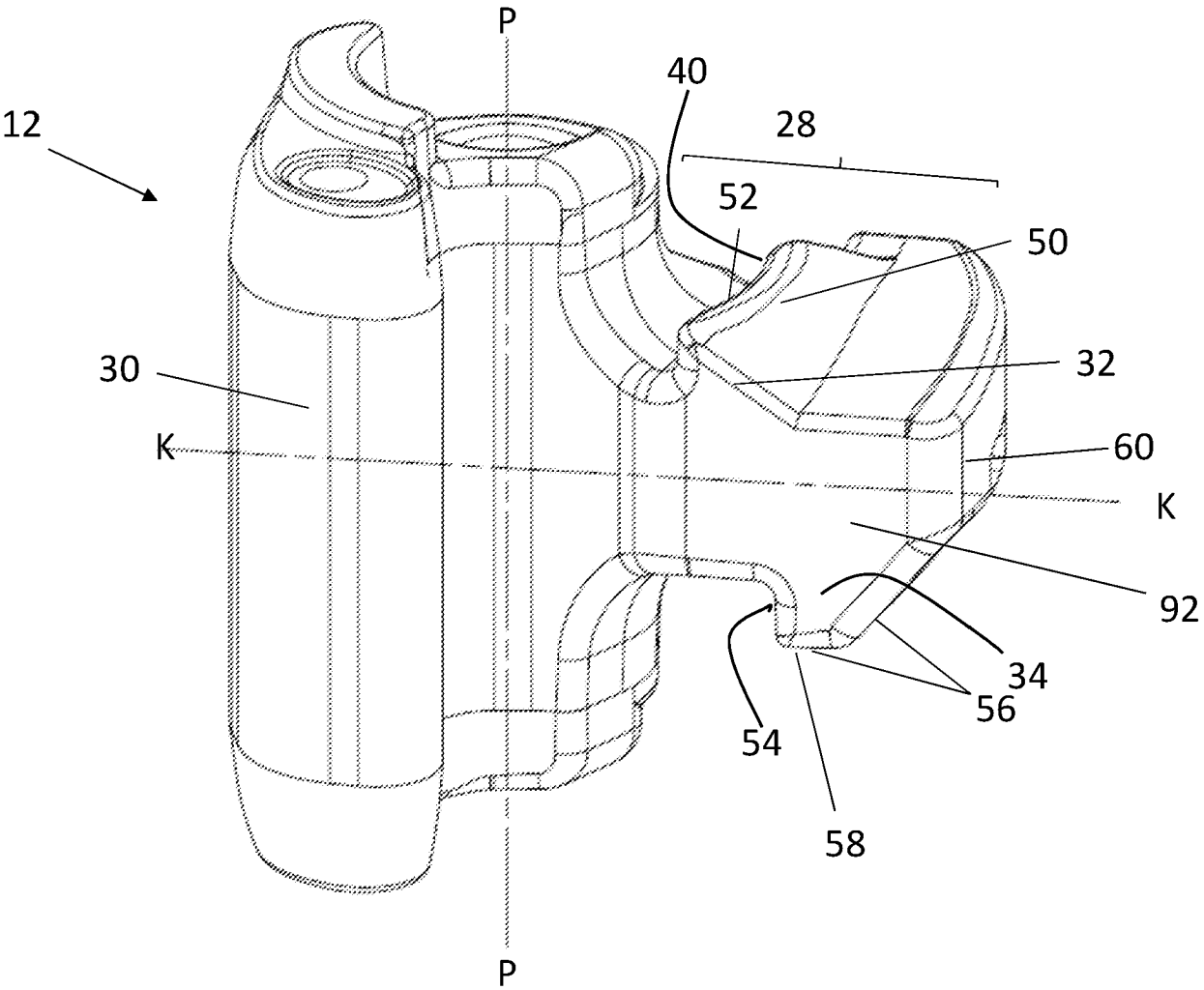
FIG. 3 is a perspective view of an embodiment of the knuckle of FIG. 2.

Referring to FIGS. 2 and 3, the knuckle 12 extends between a protruding portion 30 at one end and the tail 28 at the other end. The knuckle 12 generally extends along a knuckle longitudinal axis K-K. The protruding portion 30 engages the complementary knuckle of the coupler for the adjoining rail wagon (not shown). The knuckle 12 includes lugs 32, 34 and pin protectors to increase strength and to transfer the working forces away from the coupler head portion 16 extremities and into the coupler body 10. The upper and lower lugs 32, 34 of the knuckle 12 engage corresponding lugs 36, 38 in the coupler body 10 and take most of the strain under pulling action.

The tail 28 extends along the axis K-K for coupling with the head portion 16 of the coupler 100. In particular, the tail 28 of the knuckle 12 includes the upper and lower lugs 32, 34 (when in use the lugs are positioned vertically so as to be upper and lower). The lugs 32, 34 extend in a lateral direction relative to the axis K-K.

Figure 4:
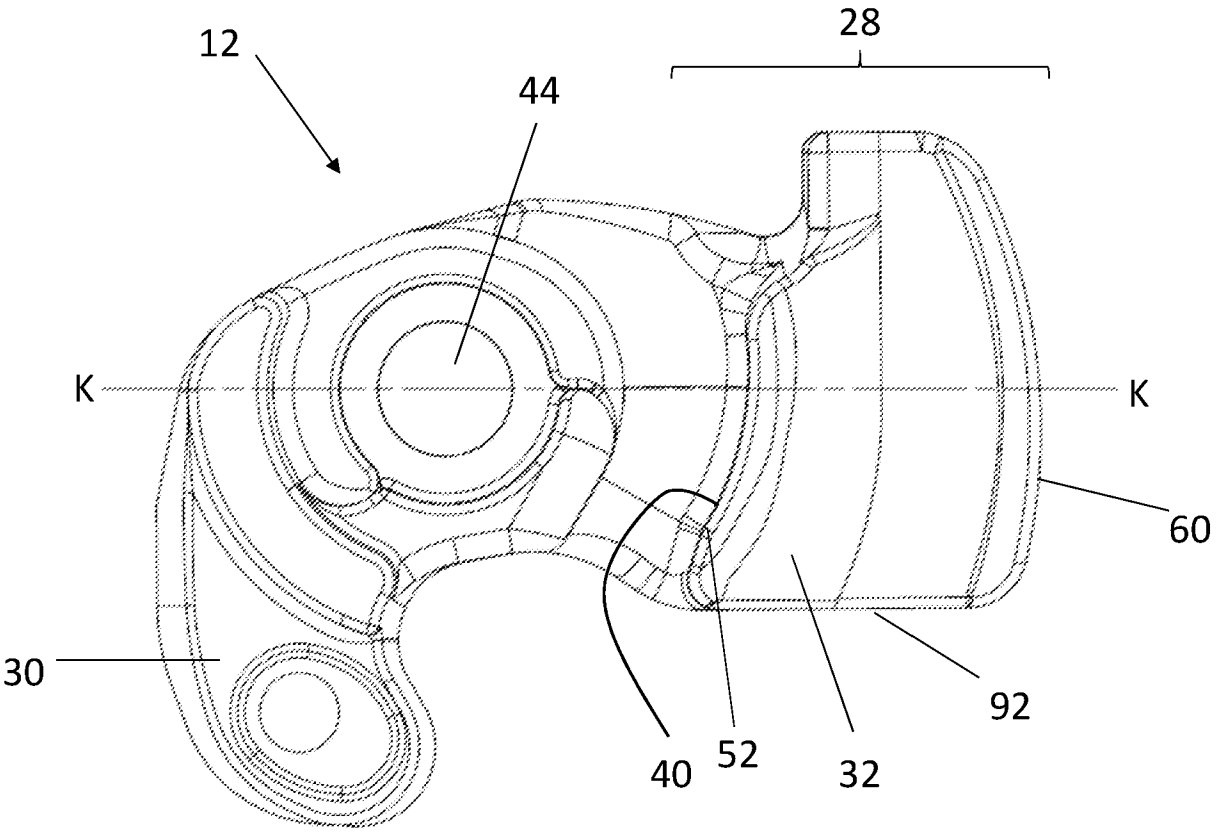
FIG. 4 is a plan view of the embodiment of the knuckle of FIG. 4.

The upper lug 32 includes an engagement surface 40 extending transverse to the axis K-K and across at least a part of the width of the tail 28. In some embodiments, the engagement surface 40 extends across most or all of the width of the tail 28. As best shown in FIG. 4, the engagement surface 40 of the upper lug 32 is arcuate to complement the corresponding surface of the head portion 16 and is configured to promote the movement of the knuckle 12 from the open to the closed position. The knuckle 12 is configured to rotate about pivot axis P-P and a pivot pin extending along the pivot axis. The pivot pin 42 extends through an aperture 44 of the knuckle 12 and into top and bottom ends 46, 48 of the head portion 16. The radius of the engagement surface 40 may vary and be of an alternative profile. The upper lug 32 also includes an angled surface 50 tapering from a top edge 52 of the engagement surface 40 to the end of the tail 28. In general, from a side view the profile of the upper lug 32 is triangular, and in some forms, the profile is a right-angled triangle.

The bottom lug 34 also includes an engagement surface 54 extending transverse to the axis K-K and across at least a part of the width of the tail 28. In some forms, the engagement surface 54 of the bottom lug 34 extends across most or all of the width of the tail 28. Like the upper lug 32, the engagement surface 54 of the lower lug 34 is arcuate from a bottom view (not shown). The lower lug 34 also includes a surface 56 generally tapering from a lower edge 58 of the lower lug 34. The surface 56 extends in the same direction as the axis K-K and then turns through an angle to taper more sharply upwardly and extend on an angle to the end of the tail 28. The transitions between the surfaces of both lugs 32, 34 include radiused transition regions.

In general, from a side view the overall profile of the tail 28 is an asymmetrical arrow head coming to a narrowed end surface 60 at the end of the tail 28. This configuration is designed to fit within the interior cavity 24 of the head portion 16 of the coupler body 10.

Figure 5:
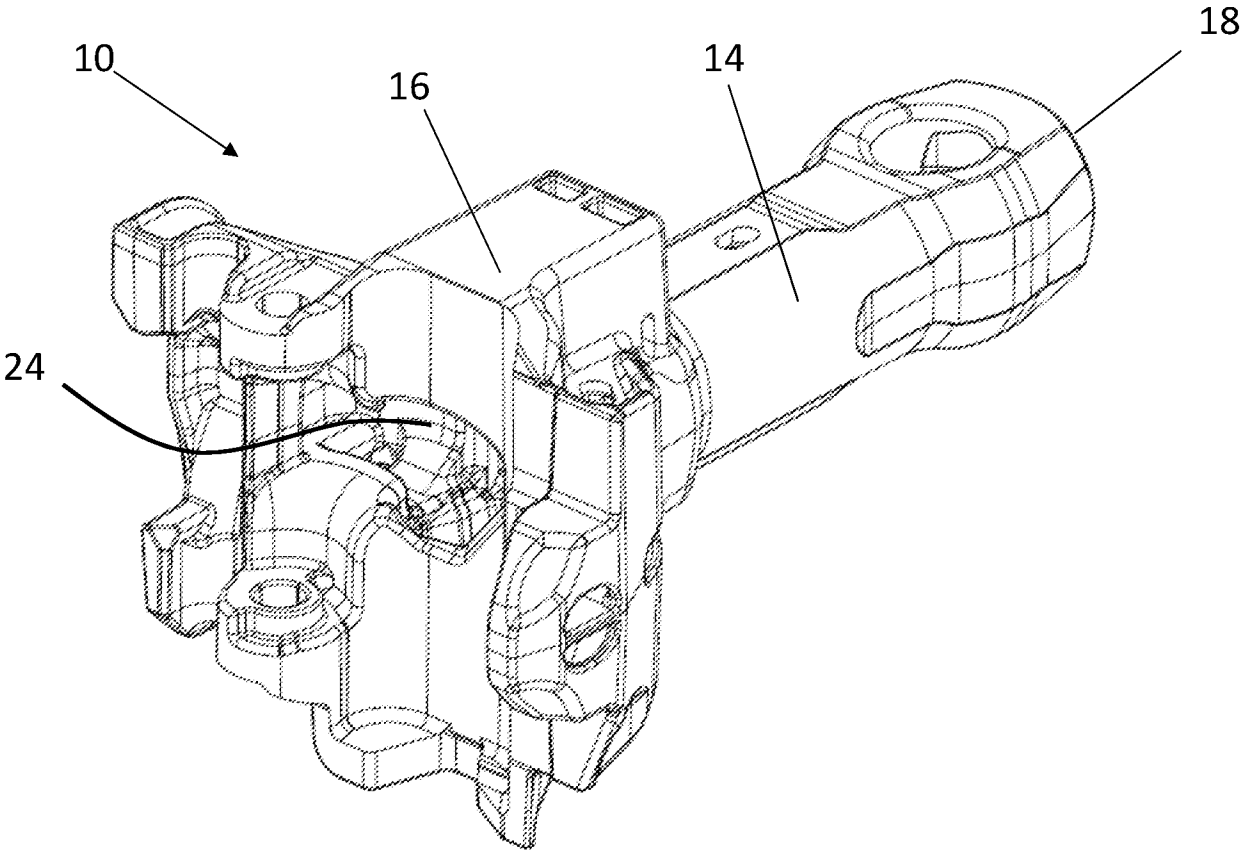
FIG. 5 is a perspective view of the coupler body of FIG. 1.
Figure 6:
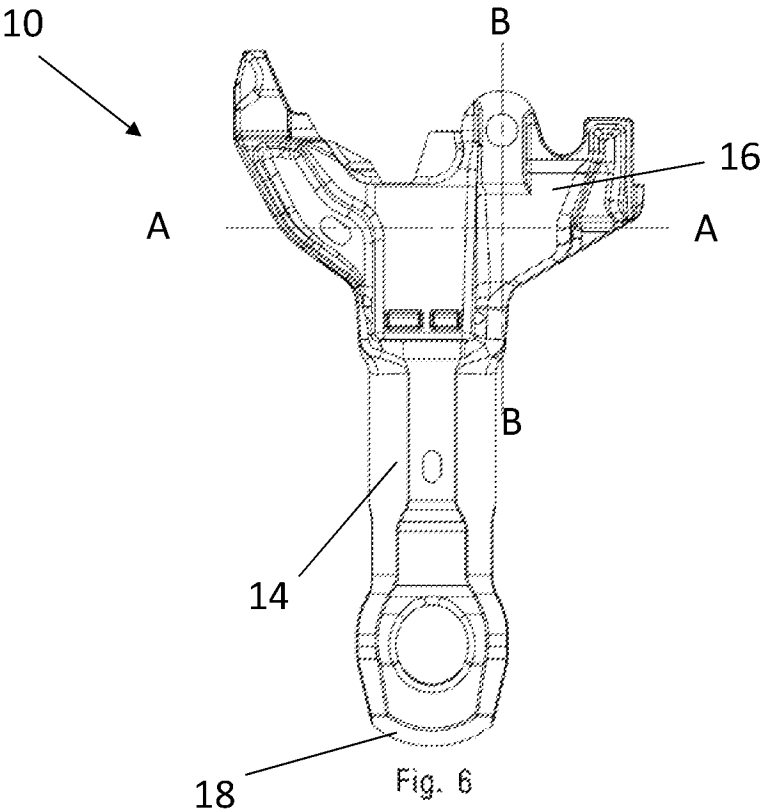
FIG. 6 is a plan view of the coupler body of FIG. 1.
Figure 7:
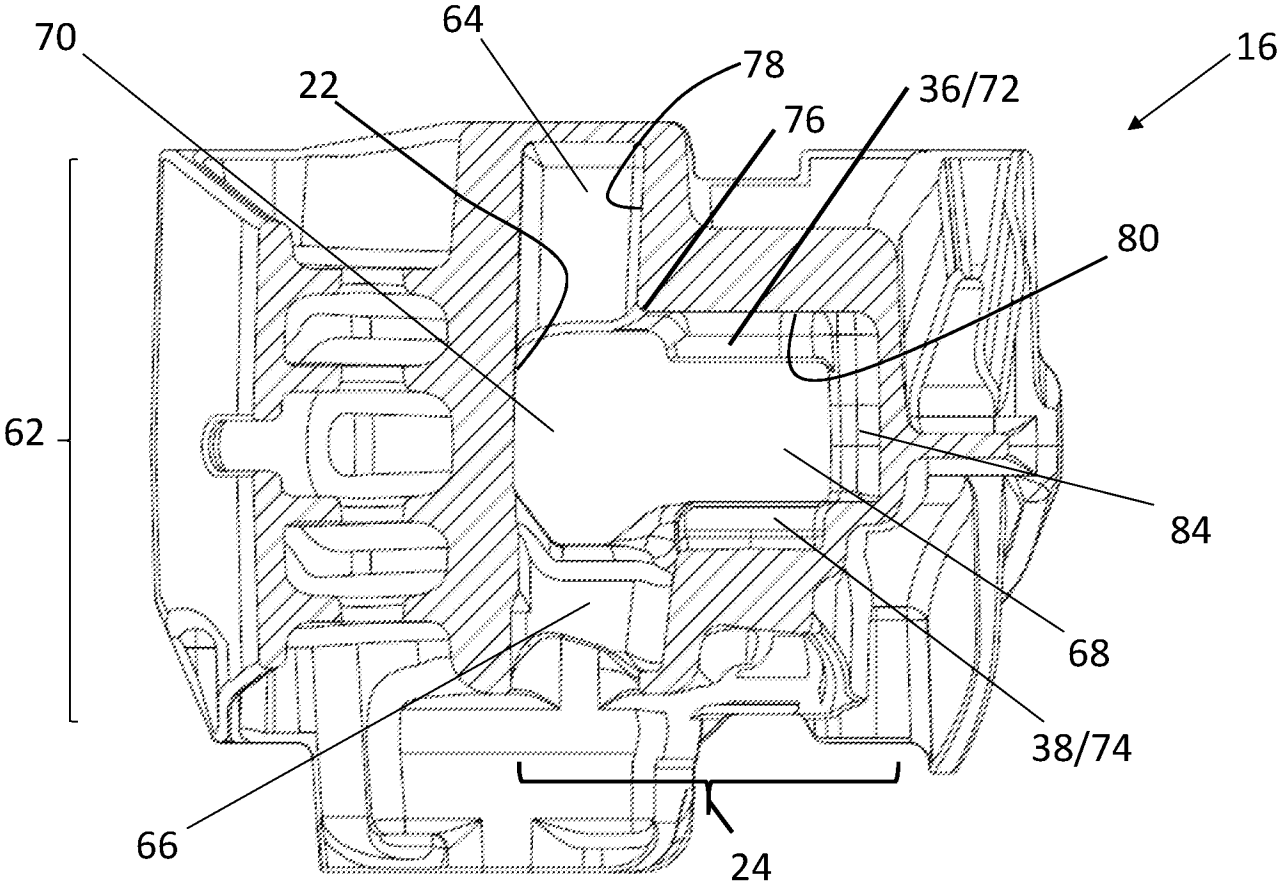
FIG. 7 is a cross-sectional view through the plane A-A of the coupler body of FIG. 6.

Now referring to the coupler body in FIGS. 5 to 7, and in particular, the interior cavity 24 of the coupler body 10 best shown in FIG. 7. The interior wall 22 defines a generally T-shaped interior cavity 24. A cross-bar 62 of the T-shaped cavity 24 extends vertically when in use between a first end and a second end of the interior cavity 24, and a stem 68 of the T-shaped cavity extends generally perpendicular to the cross-bar portion 62 of the T-shaped interior cavity 24.

The interior wall 22 defines upper and lower lugs 36, 38 in the stem cavity 68 which correspond to, and engage with, the upper and lower lugs 32, 34 of the knuckle 12. Both the upper and lower lugs 36, 38 of the head portion 16 each include an engagement surface 72, 74 that extends laterally to the axis K-K of the knuckle 12. Likewise, both the engagement surfaces 72, 74 of the head portion 16 are also arcuate to guide the rotational movement of the knuckle 12 relative to the coupler body 10 between the open and the closed position.

The interior wall 22 defining the cross-bar cavity 62 includes a first end cavity 64 at the first end of the cross-bar cavity 62, a middle cavity 70 (joining to the stem cavity 68) and a second end cavity 66 at the second end of the cross-bar cavity 62. The first end cavity 64 is defined above where the middle cavity 70 meets the stem cavity 68. In use, the first end cavity 64 accommodates the lock 26 in the unlocked position, and the middle cavity 70 accommodates the lock 26 in the locked position.

The interior wall 22 defines a corner 76 between the first end cavity 64 and the stem cavity 68. The corner 76 is formed of a lock-facing wall 78 and an upper lug-facing wall 80 of the interior wall 22. The lock-facing wall 78 is arranged to contact or align with a corresponding face 82 of the lock 26 in facing arrangement when the lock 26 is in the locked position. The lock-facing wall 78 extends to the end of the lock 26 when the lock 26 is in the locked position. The upper lug-facing wall 80 generally extends perpendicular to the lock-facing wall 78 and extends to an end 84 of the stem cavity 68 of the interior cavity 24. The upper lug-facing wall 80 reinforces the interior wall 22 and the interior cavity 24 and provides strength to the head portion 16 of the coupler 10, and particularly during load transfer between the lugs 32, 34, 36, 38 of the knuckle 12 and the head portion 16 of the coupler body 10.

Both the upper and lower lugs 32, 34 of the knuckle 12 include the engagement surfaces 40, 54 that engage the corresponding engagement surfaces 72, 74 of the upper and lower lugs 36, 38 of the head portion 16. The engagement surface 72 of the upper lug 36 of the head portion 16 has similar dimensions and surface area to the engagement surface 74 of the lower lug 38 of the head portion 16. This allows for a relatively balanced engagement between the upper 32, 36 and lower 34, 38 lugs and as a result a substantially evenly distributed load transfer between the knuckle 12 and the head portion 16 of the coupler body 10.

Figure 8:
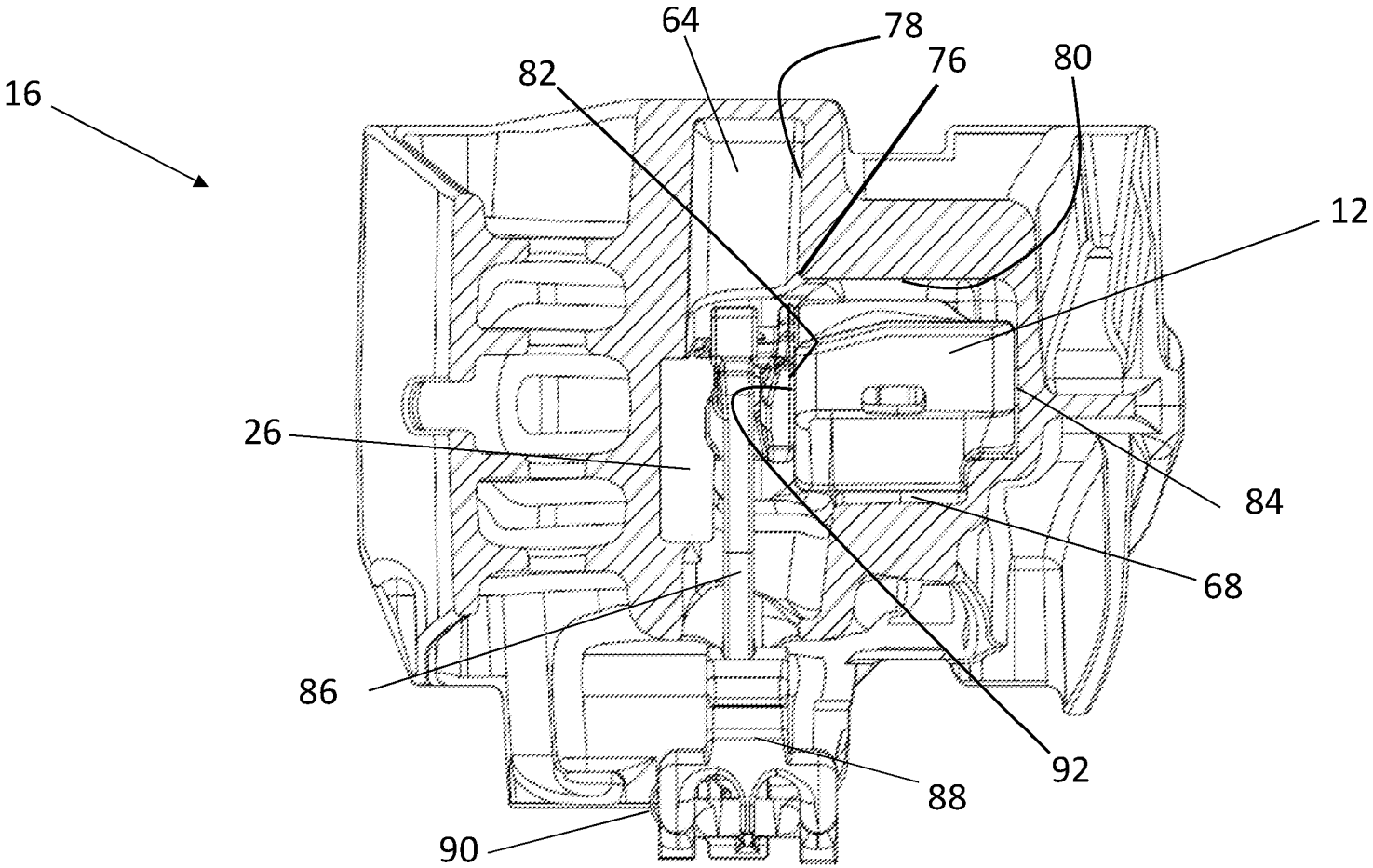
FIG. 8 is a cross-sectional view through the plane A-A of the coupler body of FIG. 6 and an end view of the knuckle of FIG. 2 in a closed position and an end view of an embodiment of the lock of FIG. 2 in a locked position.
Figure 9:
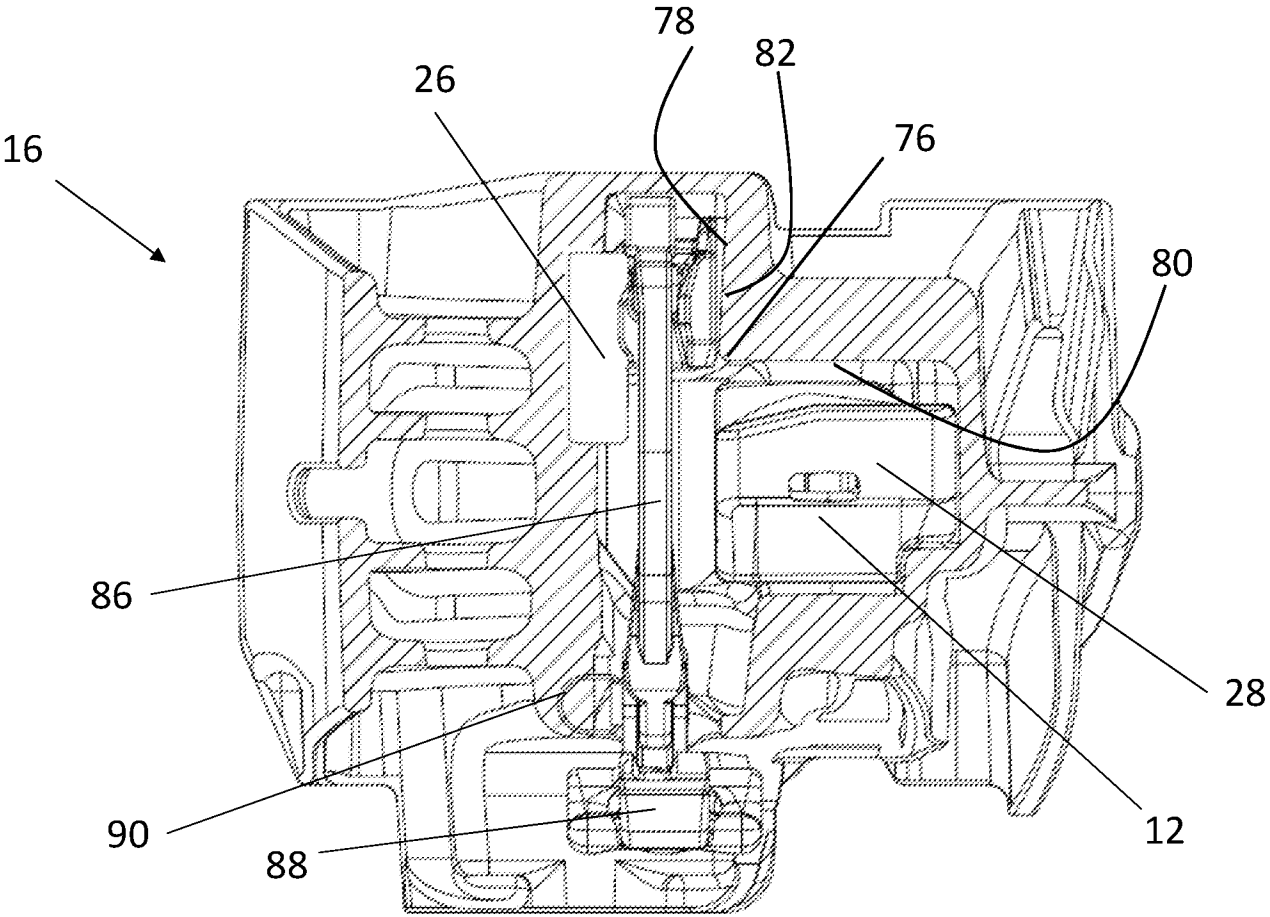
FIG. 9 is a cross-sectional view through the plane A-A of the coupler body of FIG. 6 and an end view of the knuckle of FIG. 2 in a closed position.
Figure 10:
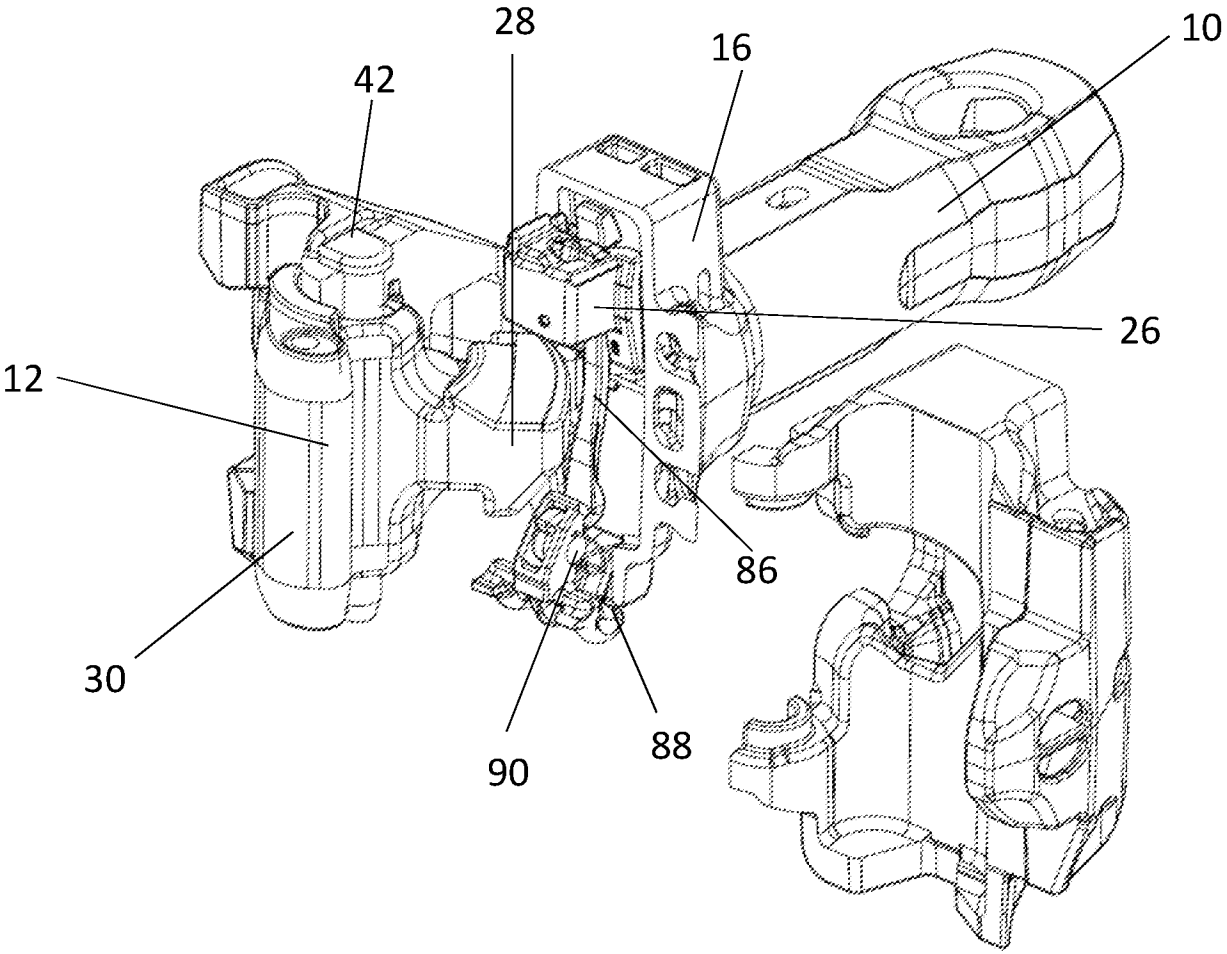
FIG. 10 is a perspective view of the coupler body of FIG. 2 including the knuckle in an open position and the lock in an unlocked position.

Now referring to FIGS. 8 to 10, the coupler 100 is illustrated including the coupler body 10, the knuckle 12, the lock 26 and the actuator mechanism. The interior cavity 24 is configured to allow movement of the lock 26 between the locked and the unlocked positions to lock the tail 28 of the knuckle 12 in the closed position and to allow movement of the tail 28 of the knuckle 12 between the closed and the open position. FIG. 8 illustrates the lock 26 in the locked position, and the knuckle 12 in the closed position. FIG. 9 illustrates the lock 26 moving towards the unlocked position and the knuckle 12 in the closed position. FIG. 10 illustrates the lock 26 in the unlocked position and the knuckle 12 in the open position.

The knuckle 12 is rotatable about the pivot pin 42, the lock 26 is secured to the actuator mechanism. The actuator mechanism includes a lifter 86, and a rotor lever 88 that pivots about a lever pin 90. The lever pin 90 acting as a hinged connection between the lifter 86 and the rotor lever 88.

Referring to FIG. 8, the lifter 86 is in a neutral position, and the lock 26 is retaining the tail 28 of the knuckle 12 in the closed position. The lock 26 is in the locked position and is positioned within the middle cavity 70 of the interior cavity 24 of the head portion 16. The lock 26 includes the lock face 82 that is in facing arrangement and in some forms abuts with a corresponding abutment surface 92 of the knuckle 12. The lock abutment face 82 and the surface 92 are generally planar.

Referring to FIG. 9, in order to uncouple the two adjacent rail cars, an uncoupling rod mounted to the rail car can be used to unlock the coupler 100. In the illustrated embodiment, the uncoupling rod is connected to the bottom of the lifter 86 and allows an operator to operate the lifter 86 without entering the potentially hazardous space between the rail cars.

When the lifter 86 is raised so as to move the lock 26 from the locked position towards the unlocked position, the upward movement of the lock 26 into the first end cavity 64 will provide clearance for the tail 28 to move into the middle cavity 70. By lifting the lock 26 upwardly, the tail 28 of the knuckle 12 is no longer prevented from rotating outwardly through the cavity 24.

The abutment lock face 82 of the lock 26 moves into a facing arrangement with the lock-facing wall 78 of the interior wall 22 defining the first end cavity 64. The abutment lock face 82 of the lock 26 and the lock-facing wall 78 are in engagement when the lock 26 is in the unlocked position. The lock 26 is translated vertically in the cavity 24 along a relatively linear path. The tail 28 of the knuckle 12 is rotatable to the open position along a transverse arcuate path to the lock 26.

In FIG. 10, the tail 28 is no longer being retained by the lock 26. There is clearance between the lock 26 and the tail 28 of the knuckle 12. The lock 26 and knuckle 12 form a corresponding corner to the corner 76 formed by the interior wall 22 of the head portion 16. The knuckle 12 may be manually rotated to the open position or the rail wagons drawing apart may rotate the knuckle 12 to the open position. Full open position of the knuckle 12 is obtained by further raising of lock 26 until a knuckle stop contacts a coupler body stop (as shown in FIG. 10).

When it is desired to couple or recouple the couplers of the two adjacent rail wagons, as the cars come together the tail 28 of the knuckle 12 of one of the couplers is struck by the protruding portion 30 of the adjacent knuckle of the other of the couplers. This interaction causes the tail 28 of one of the knuckles to rotate back into the cavity within the coupler body. In other words, to move the knuckle 12 to the closed position, the coupler 100 automatically couples with the adjoining coupler when the two rail wagons are buffed together. The lock resumes the locked position under gravity.

For bottom operated couplers (as in the illustrated embodiment), the rotor lever 88 is pivoted downwards about the lever pin 90, pulling the lifter 86 downwards and thereby shifting the lock 26 downward such that it locates adjacent to the recessed tail 28 of the knuckle 12, blocking the tail 28 from swinging back through its arc to exit the cavity 24.

As discussed above, the coupler disclosed herein may equally be applied to a top operated coupler. For top operated couplers, the lifter is allowed to drop within the coupler body, shifting the lock downward so as to locate adjacent to the recessed tail of the knuckle (in the closed position), blocking the tail from swinging back through its arc to exit the recess.

The knuckle is thus configurable, for both top and bottom operated couplers, to be locked in the closed position. With the protruding portions of the knuckles of the two adjacent rail cars hooked over one another, the coupler secures the two rail cars in adjacency such that a movement of a first of the rail cars pulls the second of the rail cars in the same direction.

Furthermore, when connecting or disconnecting the couplers of two adjacent rail cars, only one of the couplers needs to be configured into the open-knuckle position.

Figure 11B:
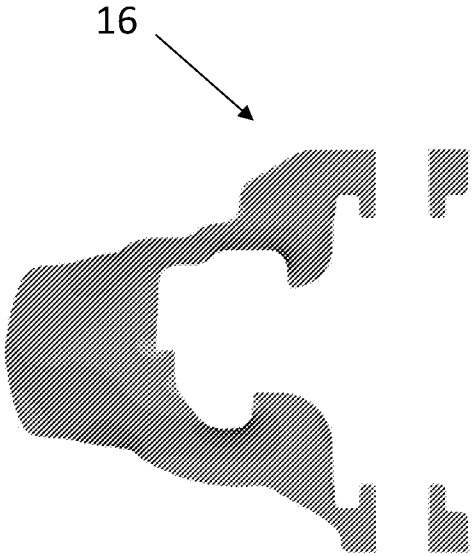
FIG. 11*b* is the cross-sectional view of FIG. 11*a* illustrating an embodiment of the maximum cyclic stress under draw and buff load.
Figure 11A:
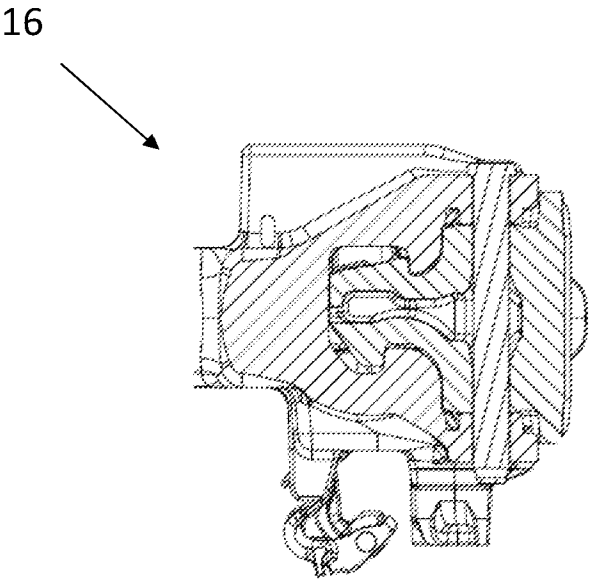
FIG. 11*a* is a cross-sectional view through the plane B-B of the coupler body of FIG. 6.

Now referring to FIG. 11 which illustrates the maximum cyclic stress under draw and buff load when the coupler 100 is connected to the coupler of an adjoining wagon, the couplers transmit both buff (compressive) and draw (tensile) loads between the adjoining rail wagons. The buff and draw loads are generated by multiple sources, including the locomotive acceleration, the braking system throughout the train, indexing machines used to unload the wagons, and undulations in the track. Furthermore, embodiments of the coupler in the form of a rotary coupler may be subject to additional rotational forces when the rotary rail wagon is rotated about an adjoining fixed rail wagon during unloading. It is understood by those skilled in the art that the coupler 100 including the knuckle 12 are part of the primary load path for these in-train buff and draw loads.

Buff and draw loads may be responsible for fatigue failures in the coupling arrangement. The buff and draw loads are transmitted through the adjoining knuckles and through the adjoining couplers. In prior art coupler arrangements (i.e. an Alliance coupler including a kicker to throw the knuckle open) the internal space required to accommodate the kicker within the internal cavity of the head portion and the moving nature of the kicker including a pin means that buff and draw loads are transmitted through a convoluted load path through the coupler between the knuckle, the head and the shank. For example, the top and bottom pulling lugs of the knuckle engage corresponding lugs in the coupler body and take most of the strain under pulling action. This commonly leads to several areas of stress concentration which fatigues and limits the life of the prior art coupler and in particular the knuckle. The cavity to accommodate the kicker on the Alliance coupler design compromises the connection of the coupler upper pulling lug with the coupler head and as such limits the transfer of the working forces away from the top pulling lug and into the coupler head extremities. As the lower pulling lug has greater connection with the coupler head it is able to carry more load than the top pulling lug. As a result, the coupler and (e.g., the knuckle) may fail during operation and result in a train separation, i.e. decoupling of adjoining rail wagons.

Without this accommodation of the moveable kicker parts in the interior cavity of the head portion, the load path through the coupler 100 is transferred along a substantially evenly distributed load path and in some forms, a substantially direct load path, for example, between the upper 32, 36 and lower 34, 38 pulling lugs of both the knuckle 12 and the head portion 16. This may reduce stress concentrations in the part and consequently may lower the stresses in the coupler 100. Furthermore, this may extend both the fatigue life and the operational reliability of the coupler 100.

Buff and draw loads may be responsible for fatigue failures in the coupling arrangement. The buff and draw loads are transmitted through the knuckles and through the coupler bodies of the adjoining rail wagons. In prior art coupler arrangements (i.e. coupler arrangements where a kicker is used to throw the knuckle open) the moving nature of the kicker means that buff and draw loads are transmitted through a convoluted load path around the kicker within the coupler head portion. This commonly leads to several areas of stress concentration which fatigues and limits the life of the coupler. As a result, the coupler may fail during operation and result in a train separation, i.e. decoupling of adjoining rail wagons.

The coupler 100 disclosed herein finds particular use in heavy haul railway applications. In-use, the dynamic effects of the heavy haul application on the overall wagon (through braking, locomotive tractive effort, indexing forces, track undulations) generate large axial loads through the drawgears. For example, axial loadings through the rail wagon drawgears can range from 1000 kN to 4000 kN. In some circumstances, the axial loading can exceed this range. Further, indexing arms (not shown), in-use, position rotary rail wagons within a rotary dumping cell (not shown) to empty contents contained within the wagon. During the process of indexing the rail wagons, the indexing arms generate high repeat fatigue loads in the knuckles and coupler bodies. These loads may contribute approximately fifty percent of the fatigue damage observed in the knuckles and coupler bodies. Advantageously, the more direct load path and lower stresses of the coupler body 10 disclosed herein can provide the appropriate fatigue strength to meet the operating requirements of the heavy-haul railway wagon. The upper pulling lugs 32, 36 will be able to take increased load (relative to the prior art couplers), and the load taken by the lower pulling lugs 34, 38 is therefore reduced. The result is a substantially evenly distributed load path.

A direct load path may comprise a load path within the coupler that is non-convoluted, low in convolution or less convoluted than prior art load paths. A direct load path may be partially or fully linear as it extends through the coupler. For example, a direct load path may transfer load linearly between the knuckle 12 and the head portion 16 of the coupler body 10. Similarly, a substantially evenly distributed load path may comprise a load path where load is distributed evenly or near evenly between the knuckle 12 and the head portion 16 of the coupler body 10. An evenly distributed load path may comprise a load path where the stress concentration on the upper pulling lug 32, 36 within the coupler 100 is similar to or consistent with the stress concentration on the lower pulling lug 34, 38.

Variations and modifications may be made to the parts previously described without departing from the spirit or ambit of the disclosure.

For example, the coupler disclosed herein is applied to a rotary coupler. The rotary coupler does not comprise an uncoupling rod as the coupler is allowed to spin about its longitudinal axis. Instead, the operator can either unlock the knuckle of the fixed coupler of the pair using an uncoupling rod, or manually unlock the knuckle of the rotary coupler by hand. When standing adjacent to the coupler, it may generally be easier for an operator to manually open the knuckle of the coupler by hand than to manually raise the lifter without an uncoupling rod.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A coupler for a coupling arrangement for a heavy haul rail wagon, the coupler comprising:

a body; and a knuckle movable relative to the body, the knuckle including a tail rotatable relative to the body about a knuckle axis a closed position and an open position, the tail of the knuckle including a single upper lug and a single lower lug configured to respectively engage a corresponding single upper lug and a single lower lug of the body, the knuckle further comprising a protruding portion that is engageable in use with a complementary knuckle of a coupler for an adjoining rail wagon when in the closed position;

the body comprising at one end a head portion including an interior wall defining an interior cavity for receiving the tail of the knuckle and having the corresponding single upper and lower lugs extending therefrom, and a butt portion at an opposing end of the body for engaging a yoke;

the coupler further comprising a lock disposed in the interior cavity and moveable from a locked and an unlocked position, and when the lock is in the locked position, the knuckle is retained in the closed position and when in the unlocked position, the coupler is adapted so that the knuckle is moveable to the open position without use of a kicker housed within the interior cavity; and wherein the interior wall defines a generally T-shaped interior cavity including a cross-bar cavity for receiving the lock and a stem cavity for receiving the tail of the knuckle and wherein the corresponding single upper and lower lugs defined by the interior wall respectively extend from an intersection of the lock cavity and the stem cavity to an end of the stem cavity, wherein in use load transfer within the coupler is accommodated through engagement of the tail with the body within the stem cavity including by engagement between the single upper and lower pulling lugs of the knuckle and the corresponding single upper and lower pulling lugs of the body, and the body is configured such that the interior wall defining the stem cavity and extending to the exterior of the body is continuous, wherein the interior wall does not include a kicker cavity, and wherein the load path from each corresponding single upper and lower pulling lug is non-convoluted so as to be substantially devoid of areas of significant stress concentration.

2. A coupler according to claim 1, wherein, in use, the load transfer within the coupler is substantially evenly distributed between the upper and lower pulling lugs of the knuckle and the corresponding upper and lower pulling lugs of the body.

3. A coupler according to claim 1, wherein, in use, the load transfer within the coupler transfers load partially or fully linearly extending through the coupler between the knuckle and the body from each corresponding upper and lower pulling lug to the butt portion.

4. A coupler according to claim 1, wherein each of the corresponding single upper and lower pulling lugs includes a consistent profile.

5. A coupler according to claim 1 wherein each corresponding upper and lower pulling lug of the body includes an engagement surface extending from the intersection to the end of the stem cavity.

6. A coupler according to claim 5, wherein the interior wall defines opposing lug-facing walls extending respectively along the corresponding upper and lower lugs defining the stem cavity, the lug-facing wall is configured to be in facing relationship with the tail of the knuckle when the knuckle is in the closed position and the upper and lower lugs of the knuckle are in engagement with the corresponding upper and lower lugs of the body.

7. A coupler according to claim 6, wherein each lug-facing wall extends linearly from the intersection to an end of the stem cavity.

8. A coupler according to claim 7, wherein each lug-facing wall extends continuously from the intersection to an end of the stem cavity.

9. A coupler according to claim 6, wherein the interior wall includes a lock-facing wall defining a portion of the lock cavity, and the lock-facing wall and the lug-facing wall meeting at the intersection formed between the lock-facing wall and the lug-facing wall, wherein the lock-facing wall, in use, is in facing arrangement with the lock.

10. A coupler according to claim 9, wherein the lock-facing wall is arranged to contact or align with a corresponding face of the lock in facing arrangement when the lock is in the locked position.

11. A coupler according to claim 1, wherein the knuckle is movable to the open position by manual force.

12. A coupler according to claim 1, wherein movement of the rail wagon away from the adjoining rail wagon moves the knuckle to the open position.

* * * * *